United States Patent [19]

Rose

[11] 4,008,403

[45] Feb. 15, 1977

[54] SAFETY CIRCUIT AND SOCKET CONSTRUCTION

[76] Inventor: Manning I. Rose, 2301 Glenheath, Dayton, Ohio 45440

[22] Filed: Sept. 30, 1974

[21] Appl. No.: 510,215

[52] U.S. Cl. ..... 307/113; 200/51.09

[51] Int. Cl.[2] ..... H01H 47/00

[58] Field of Search ..... 200/51.09; 315/362, 315/119, 125, 127; 317/154, 155; 307/113, 114, 115

[56] References Cited

UNITED STATES PATENTS

| | | | |
|---|---|---|---|
| 1,184,090 | 5/1916 | Frerks | 317/155 |
| 2,179,797 | 11/1939 | Nemeth | 200/51.09 |
| 2,221,345 | 11/1940 | Davis | 200/51.09 |
| 2,268,061 | 12/1941 | Richards | 200/51.09 |
| 2,306,741 | 12/1942 | Miller | 200/51.09 |
| 2,439,385 | 4/1948 | Goldberg | 200/51.09 |
| 2,688,669 | 9/1954 | Quill | 200/51.09 |
| 3,020,366 | 2/1962 | Dolph | 200/51.16 |
| 3,155,788 | 11/1964 | Drago | 200/51.09 |
| 3,579,171 | 5/1971 | Woodward | 339/34 |
| 3,755,635 | 8/1973 | McGill | 200/51.09 |

*Primary Examiner*—Robert K. Schaefer
*Assistant Examiner*—Morris Ginsburg
*Attorney, Agent, or Firm*—Dybvig & Dybvig

[57] ABSTRACT

An electrical socket and associated circuitry is provided wherein current can flow to the socket only when a load device is in the socket and a normally open, momentary "make" switch is closed. The circuitry includes a relay for actuating a switch in parallel with the momentary make switch, which relay is energized upon closure of the momentary make switch and remains energized so that current will continue to flow to the socket until a normally closed, momentary "break" switch is opened. Current cannot flow through the socket with the load device removed even if one should touch the socket except in the unlikely event the make switch is closed.

Several embodiments are disclosed wherein no current can flow through the socket unless at least three socket parts are engaged. In one form of socket, the socket base contact is divided into two parts, both of which must be engaged in order for the relay to remain energized. In another form the socket shell contact is divided into two parts and again both parts must be engaged for the relay to remain energized. Other sockets are illustrated wherein the presence of a load device is sensed by switch means which may include the socket base contact.

Circuits for use with polarized plugs are disclosed and a form of circuit for use with an unpolarized plug is also disclosed. Further, a circuit utilizing a rectifier and a low voltage relay is also disclosed wherein the make and break switches are in low power lines.

11 Claims, 9 Drawing Figures

FIG-1
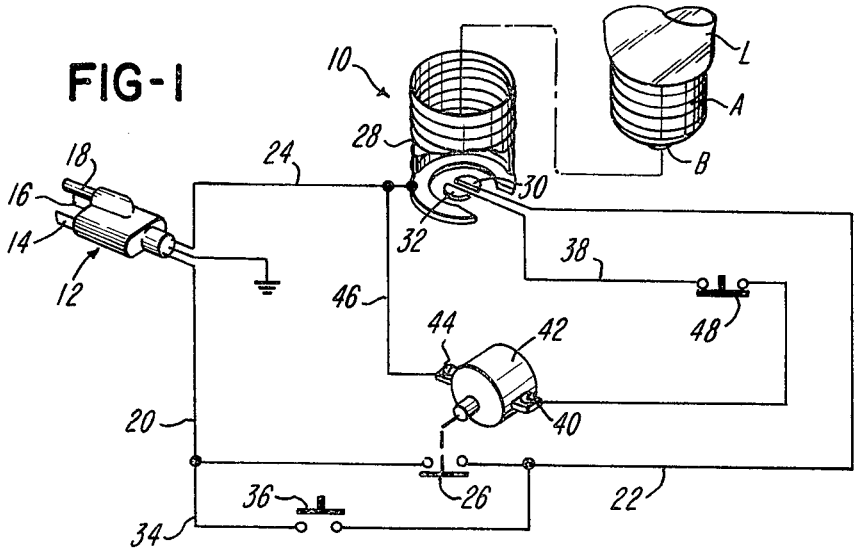
FIG-2
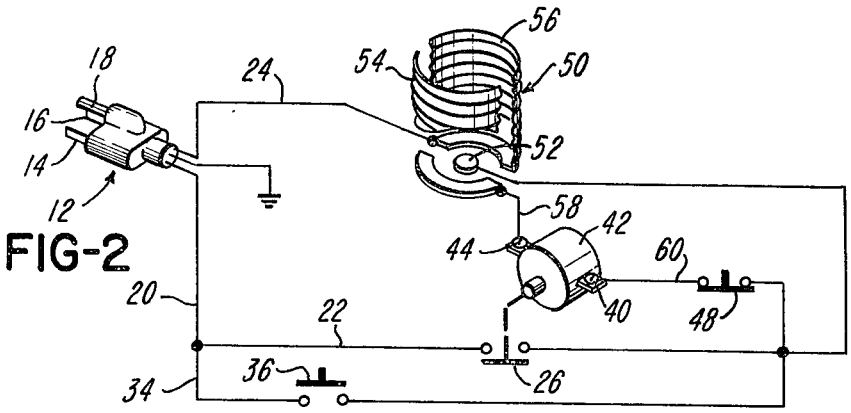
FIG-3
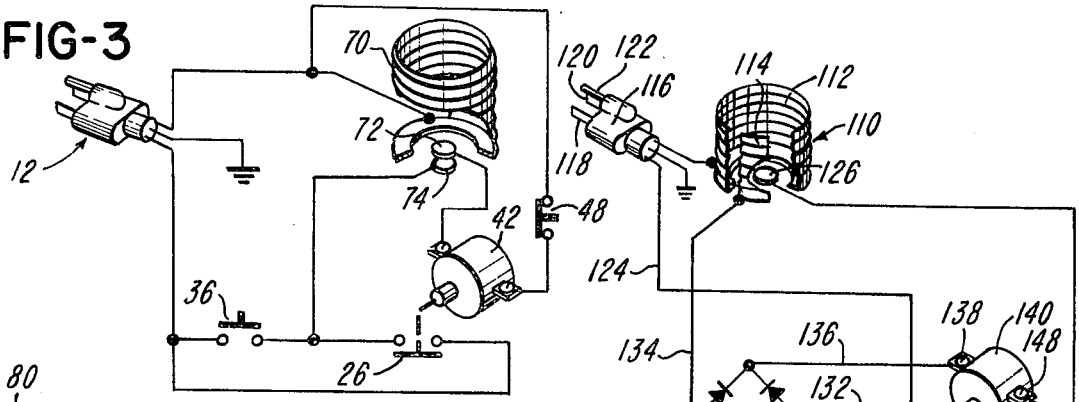
FIG-4
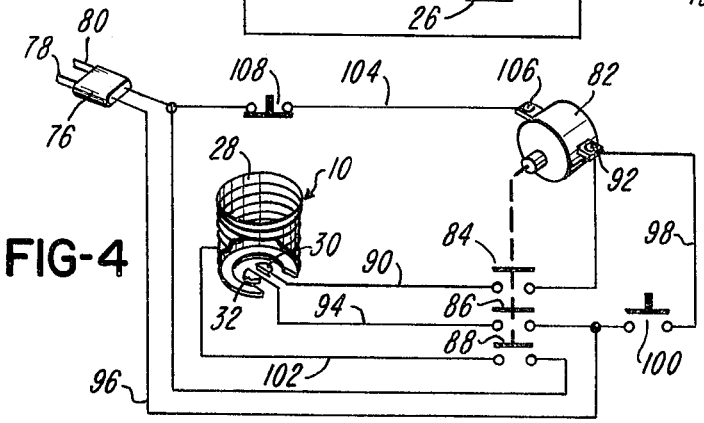
FIG-5

SAFETY CIRCUIT AND SOCKET CONSTRUCTION

BACKGROUND OF THE INVENTION

This invention relates to sockets for electrical devices and circuitry associated therewith. Although not necessarily so limited, this invention is disclosed in relation to sockets of the type having a cylindrical socket shell contact and a base contact, the socket shell having corrugated threads for receiving the base of a light bulb or other load device.

Typical sockets which receive ordinary lamps with standard screw shell bases are unsafe since a person can insert his finger into an energized socket when the lamp is removed and touch the exposed contacts or terminals therein so as to receive a burn, a painful shock, or an injury. Usually there is no indicator, or an inadequate indicator, of the energized condition of the socket.

Safety sockets have been proposed which permit persons to lightly touch one or both socket contacts where either or both terminals have been de-energized by mechanical means when the lamp has been removed from the socket. Such devices are generally unsatisfactory because if pressure is applied to the same degree as a lamp base would apply pressure when inserted into the socket, the terminals will be re-energized and may cause shock and injury.

Safety sockets have been proposed having electrical terminal contacts retracted by mechanical means from the immediate socket area to preclude accidental contact with energized contacts when the lamp is removed. As the lamp is reinserted into the socket, the retracted terminals reappear in the socket area by the normal pressure of the lamp insertion. Such devices are generally unsatisfactory because if some pressure is applied by a finger of a person in the same manner as a lamp base would provide such pressure when inserted into the socket, the person thus inserting his finger will reactivate the terminals into the socket area and, again, may be subject to possible shock and injury.

Safety sockets have also been proposed where the electrical terminals are located in recesses and must be used with specially designed lamps for insertion into the socket. The recesses which contain the electrical terminal are of sufficiently small size as to provide a person from touching the terminal when a finger is inserted into the socket. Such devices are also generally unsatisfactory because the requirement for specially designed lamp bases limit their usefulness. Usually only one terminal is recessed. In such case, a person may touch the exposed terminal and establish an electrical circuit between the exposed terminal and the ground return and thereby provide the possibility of shock.

Representative safety sockets are shown in the following United States patents:

| Inventor | Patent No. | Issue Date |
|---|---|---|
| Nemeth | 2,179,797 | Nov. 14, 1939 |
| Davis | 2,221,345 | Nov. 12, 1940 |
| Richards | 2,268,061 | Dec. 30, 1941 |
| Miller | 2,306,741 | Dec. 29, 1942 |
| Goldberg | 2,439,385 | Apr. 13, 1948 |
| Quill | 2,688,669 | Sept. 7, 1954 |
| Dolph | 3,020,366 | Feb. 6, 1962 |
| Drago | 3,155,788 | Nov. 3, 1964 |
| Woodward | 3,579,171 | May 18, 1971 |

SUMMARY OF THE INVENTION

The present invention provides a socket with a circuit constructed to significantly reduce the likelihood of accidental shock and injury to a person who inserts a finger in the socket. The socket is completely de-energized when the lamp is removed.

In accordance with this invention, current cannot flow through the socket unless one of two normally open switches is closed. One of the normally open switches, termed a momentary make switch, is preferably remotely located from the socket so that it would be very unlikely for one to insert his fingers into the socket and at the same time close the make switch. The other normally open switch is a relay switch. The socket is so constructed that the relay switch can remain energized only if the socket terminal contacts are engaged by a conductor. In order to thus control the operation of the relay, the socket base contact or, alternatively, the socket shell contact is divided into two parts, both of which must be engaged by a common conductor to complete the relay circuit. In normal operation the lamp base terminals serve as the conductors which complete the relay circuit. In other embodiments, the socket is provided with a sensing switch in the relay circuit which must be closed in order to permit energization of the relay. The sensing switch may include the base contact.

Further in accordance with this invention, the normally open switches are in conductors connected to the source prong or terminal of a plug connector. When using an unpolarized plug, additional normally open relay switches are provided so that there is a normally open switch in every conductor leading to the socket.

In a further embodiment of this invention the relay circuit includes a rectifier which enables the use of a low voltage relay and low power, direct current lines in which the make and break switches are located. Such embodiment of the invention is well suited to ceiling lamp fixtures and the like because the wall mounted switches connected thereto can be connected by low power lines which are both less expensive and safer than high power lines.

It is recognized that holding relays have been used in lamp circuits for other purposes as shown in U.S. Pat. No. 1,184,090 granted to Frerks on May 23, 1916. However, no prior use or suggestion of a relay circuit for the purposes of this invention is known.

All of the disclosed embodiments of this invention can be used with sockets adapted to receive ordinary lamps and similar electrical appliances having standard screw shell bases. In all cases the likelihood of accidental shock and injury to a person who inserts his fingers into an empty socket is kept to a minimum because no current will flow to the socket unless a remote, normally open switch is closed.

BRIEF DESCRIPTION OF THE DRAWINGS

FIG. 1 is a schematic diagram of an embodiment of this invention employing a split base contact in the lamp socket.

FIG. 2 is a schematic diagram of a second embodiment of this invention employing a split socket shell.

FIG. 3 is a schematic diagram of another embodiment of this invention wherein the socket base contact also serves as one contact of a sensing switch.

FIG. 4 is still another embodiment of this invention employing a split base contact as in the embodiment of FIG. 1 but utilizing a different plug construction and having additional relay operated switches.

FIG. 5 is a schematic diagram of still another embodiment of this invention wherein a low power circuit is utilized to control the operation of a lamp.

DESCRIPTION OF THE PREFERRED EMBODIMENTS

Figure 6:
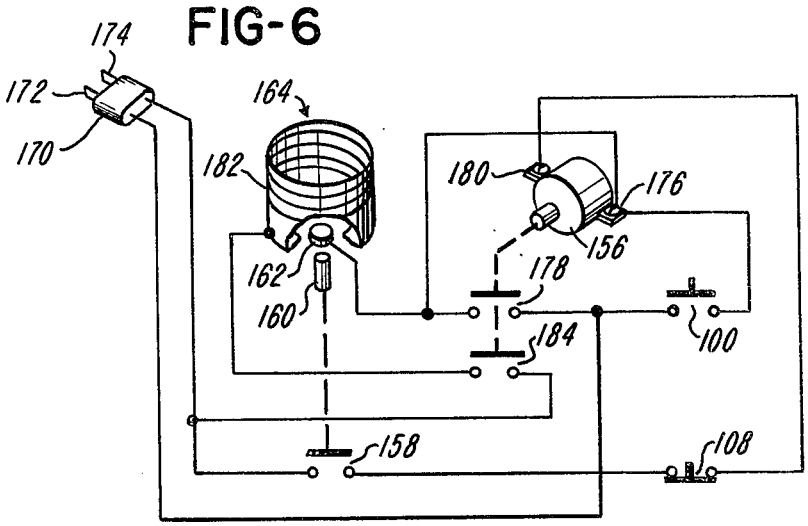
FIG. 6 is a schematic diagram of yet another embodiment of the invention wherein the socket base contact actuates a switch and utilizing the plug construction of FIG. 4.

With reference to FIG. 1, a light bulb or lamp socket generally designated 10 is shown in a circuit having a plug 12 which is of the polarized type with a source or feed prong 14, a source return prong 16 and a grounding prong 18. Source prong 14 is connected by a first conductor 20 and a second conductor 22 to the socket 10. The socket 10 is connected by a third conductor 24 to the source return prong 16. Second conductor 22 has a normally open, relay operated switch 26 therein. When the switch 26 is closed and a lamp is properly inserted in the socket 10, the lamp will be energized.

The socket 10 includes a conventional conductive shell contact 28 having corrugated threads to receive the conventional, cylindrical, threaded base terminal A of a lamp L. Socket 10 further includes a base contact structure adapted to be engaged by the raised base terminal B of the lamp L. As well known, the socket 10 can be used for any of a variety of electrical appliances having suitable base terminals. For convenience only, the description herein refers to lamp sockets, it being understood that the sockets have general utility.

Contrary to convention, the base contact structure of the socket 10 is split into two parts identified as a first contact part 30 and a second contact part 32. The second conductor 22 is connected to the first base contact part 30. The aforementioned third conductor 24 is connected to the shell contact 28. Accordingly, when a lamp is inserted into the socket 10, the circuit completed upon closure of relay switch 26 includes a conductive path from the second conductor 22, the first base contact part 30, the lamp filament, the socket shell contact 28 and the third conductor 24.

Closure of the relay operated switch 26 is controlled by a relay operating circuit including a fourth conductor 34 connected to the first conductor 20 in electrical parallel relation to the portion of the second conductor 22 in which switch 26 is located. The fourth conductor 34 has a normally open, momentary make switch 36 therein which, when closed, completes a circuit from the source prong 14 to the first base contact part 30. With a lamp L in place, its base terminal B completes a circuit between the first base contact part 30 and the second base contact part 32. The second base contact part 32 is connected by a fifth conductor 38 to one terminal 40 of a relay 42. The other terminal, designated 44, of relay 42 is connected by a sixth conductor 46 to the third conductor 24 and hence to the source return prong 16. Thus when switch 36 is momentarily closed, relay 42 is energized and the relay switch 26 is closed.

When the relay operated switch 26 is closed, the relay 42 is held energized because of the circuit from source prong 14, the first conductor 20, the second conductor 22, the first socket base contact 30, the lamp base terminal B, the second socket base contact 32, fifth conductor 38, terminal 40, relay 42, terminal 44, sixth conductor 46, source return conductor 24 and source return prong 16. Switch 26 thus acts as a holding switch and the lamp will remain energized until a normally closed, momentary break switch 48 in fifth conductor 38 is opened in which event current flow to the relay terminal 40 is interrupted. Relay 42 would then be de-energized and relay switch 26 opened. In consequence, current flow to the socket contact parts is interrupted and the lamp de-energized.

If for any reason the lamp should be removed from the socket 10 while it is energized, as soon as the lamp base terminal B is moved away from engagement with the socket contact parts 30 and 32 the relay 42 is de-energized and relay switch 26 opened. Until a lamp is replaced in the socket 10, closure of the momentary make switch 36 will not energize relay 42 because of the open circuit between the socket base contact parts 30 and 32.

From the foregoing it is seen that two conditions must be met in order for there to be any current flowing in socket 10. The two conditions are that the momentary make switch 36 is closed and a conductive path is provided between the split base contact parts 30 and 32. Accordingly, even if one should place a finger across the split contact parts 30 and 32 with the plug 12 connected to an electrical source, there is no possibility of shock unless the momentary make contact 36 is closed. The possibility of accidentally receiving a shock is thereby kept to a minimum.

The mechanical construction of the device of FIG. 1 is unimportant to this invention except for the split base contact parts 30 and 32. Preferably the socket 10 is otherwise entirely conventional. There are essentially no constraints upon the relative spacing between the socket 10, switches 36 and 48, and relay 42. Accordingly, the apparatus of this invention is suitable for a variety of applications such as drop lights, table lamps, ceiling lamps with wall switches, and so forth. Relay 42 could be mounted upon or housed with the socket 10 or it could be in a lamp base or any other suitable location. In most cases the momentary make switch 36 and the momentary break switch 48 would be located quite close to one another but as remote from the socket 10 as feasible to minimize the likelihood that one would close the momentary make switch 36 while touching the socket contacts. For convenience, switches 36 and 48 are described above as being located in their respective conductors, but they would normally be separate from the conductors. In most installations these switches would be spring biased and manually operated. As those familiar with the art are aware, switches 36 and 48 could be controlled by either a single operating member or by two operating members, one for each switch.

The embodiment of FIG. 2 operates in essentially the same manner as the embodiment of FIG. 1. The socket, generally designated 50 in FIG. 2, has a conventional one-piece base contact 52 and a split shell contact construction including a first shell contact part 54 and a second shell contact part 56. Other parts of the circuit of FIG. 2 may be identical to the circuit of FIG. 1 and are thus identified by the same reference characters. Thus, FIG. 2 includes a polarized plug 12, a first conductor 20, a second conductor 22 having a normally open relay switch 26 therein, a relay 42 with terminals 40 and 44 and a source return conductor 24. In the case of FIG. 2, the second conductor 22 is connected to the single base contact 52 and the third or source return conductor 24 is connected to shell contact part 56. The relay holding circuit is connected to the other shell part 54 and includes a conductor 58 connected to terminal 44 and a conductor 60 connected to terminal 40 which has the normally closed, momentary break switch 48 therein located between the source conductor 22 and the terminal 40. When a lamp is in place, it may be energized in the same manner as described in connection with FIG. 1. That is, the momentary make switch 36 located in conductor 34 is closed, whereupon relay 42 is energized, closing its switch 26, and the lamp is also energized.

With continued reference to FIG. 2 it will be appreciated that when socket 50 is empty, both switches 26 and 36 will be normally open and one could accidentally place his finger against both shell contact parts 54 and 56 as well as the base contact 52 without receiving a shock. The only possibility for shock in such case would occur in the event the normally open make switch 36 is also closed.

FIG. 3 illustrates a related embodiment wherein the socket, designated 70, is of conventional construction except that its base contact 72 overlies another contact 74 to form a switch that is closed when a lamp is in the socket. As described below with reference to FIG. 9, base contact 72 may be a spring contact blade having a relaxed position wherein it is spaced from the contact 74 in the absence of a lamp in the socket. The operation of the circuit of FIG. 3 is deemed obvious from the foregoing description of FIGS. 1 and 2. The switch formed by base contact 72 and the underlying contact 74 must be closed and the momentary make switch 36 must also be closed for current to flow to the socket. If a lamp is in the socket, relay 42 is energized upon closure of the momentary make switch 36 whereupon relay switch 26 is closed. Relay 42 remains energized until momentary break switch 48 is opened. One using the socket 70 of FIG. 3 could not accidentally receive a shock unless base contact 72 were engaged with enough pressure to cause it to engage the underlying contact 74 and unless the momentary make switch 36 is also closed.

FIG. 4 shows a circuit quite similar to that of FIG. 1 except that the plug, designated 76, is unpolarized and has only two prongs 78 and 80. When using such a plug, it is impossible to determine which of the prongs 78 and 80 will be connected to the source and which will be connected to the source return. For purposes of safety it is imperative in all cases that there be a normally open switch between the source and all parts of the socket. In FIG. 4 the socket is generally designated 10, the same as in FIG. 1 because it is of the same construction. Thus, socket 10 in FIG. 4 has a conventional shell 28 and split base contact parts 30 and 32. To meet the condition that all conductors connected to the socket 10 are normally open circuited, a relay 82 simultaneously operates three normally open holding or relay switches designated 84, 86 and 88. Switch 84 is in a conductor 90 extending between the first base contact part 30 and one terminal 92 of the relay 82. Switch 86 is in a conductor 94 connected to the second base contact part 32. Conductor 94 is connected by another conductor 96 to the plug prong 78 and is also connected by a conductor 98 to the aforementioned relay terminal 92. Conductor 98 has a normally open, momentary make switch 100 therein. The socket shell 28 is connected by a conductor 102, in which the switch 88 is located, to the other plug prong 80. The latter plug prong 80 is also connected by a conductor 104 to the other terminal 106 of the relay 82. Conductor 104 has a normally closed, momentary break switch 108 therein.

In the operation of the circuit of FIG. 4, closure of the normally open, momentary make switch 100 completes a circuit from prong 78 through conductors 96 and 98, relay 82 and conductor 104 to plug prong 80. Relay 82 is thus energized, whereupon the three normally open switches 84, 86 and 88 are closed. Provided that there is a lamp within socket 10 permitting conduction through its base contact across the socket base contact parts 30 and 32, the relay 82 will be held energized by the closed circuit from prong 78 through conductors 96 and 94, base contact part 32, the lamp base terminal, such as terminal B, base contact part 30, conductor 90, relay 82 and conductor 104 to prong 80. The lamp is energized so long as the relay 82 is energized by the closed circuit from prong 78 through conductor 96, conductor 94, base contact 32, shell 28 and conductor 102 to prong 80. It is apparent that relay 82 would be de-energized if the momentary break switch 108 is opened, thereby open circuiting the path between relay terminal 106 and prong 80. In such event, switches 84, 86 and 88 would be opened and there could be no current flowing to any parts of the socket 10. Alternatively, if the lamp is removed from the socket 10 while the relay 82 is energized, the relay 82 will be de-energized as soon as the base contact of the load element moves away from engagement with the socket base contact parts 30 and 32 because the circuit between conductors 94 and 90 is thus open circuited. As in the case of the preceding embodiments, one may touch any or all of the parts of the socket 10 with impunity provided that the momentary make switch 100 is not closed.

FIG. 5 discloses an embodiment wherein the make and break switches are located in low power DC lines. A socket 110 is provided which is similar to the socket 50 of FIG. 2 in that it has a first shell part 112 and a second shell part 114 and, as will be described below, lamp terminal A is relied upon to provide conduction between the two shell parts 112 and 114.

In FIG. 5 a polarized plug 116 having a source prong 118, a source return prong 120 and a grounding prong 122 is utilized. The primary circuit for energizing the lamp includes a conductor 124 which extends from the source prong 118 to the base contact, designated 126, of the socket 110. Conductor 124 is normally open circuited by a normally open relay or holding switch 128. A rectification network, which may, as illustrated, comprise a diode bridge 130 is provided, one junction of which is coupled to the source conductor 124 through a dropping resistor 132. The opposite junction is connected to the socket shell part 114 by a conductor 134. As well understood by those skilled in the art, when a lamp is present in socket 110 to provide conduction between the shell parts 112 and 114, the conductor 134 will thus be electrically connected to the source return prong 120. The diode bridge 130 is thereby connected across the source prong 118 and the source return prong 120.

A third junction of the bridge 130 is connected by a conductor 136 to a terminal 138 of a relay 140. The fourth junction of the bridge 130 is connected by a conductor 142 through a normally closed, momentary break switch 144 and a conductor 146 to the other terminal 148 of the relay 140. Conductor 146 has a normally open, momentary make switch 150 therein. Connected in electrical parallel relation to the conductor 146 and the make switch 150 is a conductor 152 having a relay operated, normally open holding switch 154 therein.

In operation, with the condition of the switches illustrated in FIG. 5 and with a lamp located in socket 110, the diode bridge 130 is not conductive and no current flows through the parts of the socket 110 because of the open switches 128, 150 and 154. Upon closure of the momentary make switch 150, a closed circuit is established between the third and fourth diode junctions to energize relay 140. This closed circuit is through conductor 142, break switch 144, make switch 150, conductor 146, relay 140 and conductor 136. The bridge 130 is designed, as conventional, to produce a low power, pulsating direct current. Accordingly, relay 140 may be any conventional, low voltage DC operated relay. Upon energization of relay 140 when the make switch 150 is actuated, relay switches 128 and 154 are closed. Accordingly, the primary circuit through the socket 110 is closed and the lamp energized. Relay 140 will remain energized even though the make switch 150 is only momentarily closed because of the closed circuit now established by closure of relay switch 154 from the bridge 130 through conductor 142, conductor 152, relay 140 and conductor 136 back to bridge 130.

In order to de-energize the lamp, the break switch 144 is momentarily opened, thus de-energizing the relay 140 whereupon switch 128 is opened to open circuit the primary circuit. Of course, relay switch 154 is also opened at the same time and the parts are returned to the position thereof illustrated in FIG. 5 so that the lamp may again be energized by momentary closure of the make switch 150. As in all of the previous embodiments, should the lamp be removed while it is energized, it will be de-energized as soon as the base contact thereof moves away from base contact 126. The relay 140 however will remain energized until such time as the lamp is removed from engagement with both socket shell parts 112 and 114. When this occurs, there is an open circuit between the conductor 134, which is connected to the bridge 130, and the source return prong 120 whereupon the bridge 130 can no longer be conductive and the relay 140 is de-energized, again causing the relay switches 128 and 154 to be opened. Accidental conduction through the socket 110 will then be impossible even if someone should accidentally touch the base contact 126 and the shell parts 112 and 114 simultaneously unless at the same time the make switch 150 should be closed.

The circuit of FIG. 5 embodies a safety feature not present in the aforedescribed embodiments in that the make switch 150 and the break switch 144 are in the low power, relay control circuit. Even if these switches should be damaged or surrounding insulation worn away, the electrical shock experienced by operation of these switches would be relatively small. Furthermore, in household applications the circuitry of FIG. 5 provides the possibility of locating all of the high power circuits in relatively restricted areas, such, for example, above the ceiling for all ceiling light fixtures. The ceiling fixtures can be connected to wall mounted switches through low power lines which are not only less expensive than high power lines but are also significantly safer.

FIG. 6 is an unpolarized plug embodiment similar to FIG. 4 but wherein the relay, designated 156, is a 2-pole rather than a 3-pole relay. The third relay switch is, in effect, replaced by a switch 158 having two spaced control elements interconnected by a plunger 160 when depressed by the base contact 162 of a socket generally designated 164 when a lamp is in the socket. The unpolarized plug 170 has two prongs, a first prong 172 and a second prong 174. One terminal 176 of the relay 156 is connected to the first prong 172 by a circuit including the momentary make switch 100 which is in electrical parallel relation to one of the relay or holding switches 178. The other terminal 180 of the relay 156 is connected to the second prong 174 through the momentary break switch 108 and the aforementioned switch 158. The socket shell contact 182 is connected to the second prong 174 through a circuit including a second relay or holding switch 184. Thus there is an open relay switch to both of the socket contact parts 162 and 182. Except when the relay is energized to close switches 178 and 184, no current can flow to the socket 164 unless the plunger 160 is depressed and unless the momentary make switch 100 is closed.

Figure 7:
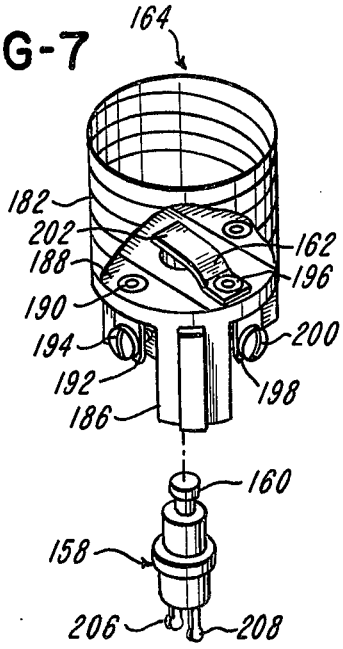
FIG. 7 is an exploded perspective view of a portion of a socket, with part broken away, having a switch such as is schematically illustrated in FIG. 6.
Figure 8:
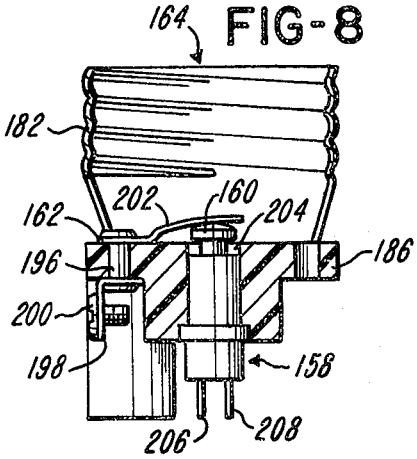
FIG. 8 is a cross sectional view of the portion of the socket and the switch shown in FIG. 7 when assembled.

FIGS. 7 and 8 illustrate the physical construction of the socket 164 and switch 158 of FIG. 6. The socket 164 includes an insulating base 186 upon which is mounted the socket shell contact 182. Shell contact 182 has a base or flange part 188 connected by a rivet 190 to a terminal connector 192 to which wire is clamped by a screw 194 in the well known manner. Base contact 162 is in the form of a spring leaf or blade connected by a rivet 196 to a terminal connector 198 having a wire clamping screw 200.

Base contact 162 is formed with an upwardly extending, free end contact portion 202 which is self-biased to the position thereof illustrated in FIGS. 7 and 8. Socket base 186 has a central aperture 204 therein in which the switch 158 is threaded or cemented. Aperture 204 is so located that the plunger 160 of the switch 158 is located beneath the upwardly extending free end portion 202 of the base contact 162. Switch 158 may be any suitable, commercially available push button or plunger operated switch and hence its construction is not illustrated. In general such switches have a plunger, such as 160, spring biased upwardly. At the base of the plunger there is a contact element (not shown) which engages the terminals such as those designated 206 and 208 when the plunger is depressed. As apparent from the foregoing, plunger 160 will be depressed when the contact portion 202 is bent downwardly as a lamp is inserted into the socket 164.

Figure 9:
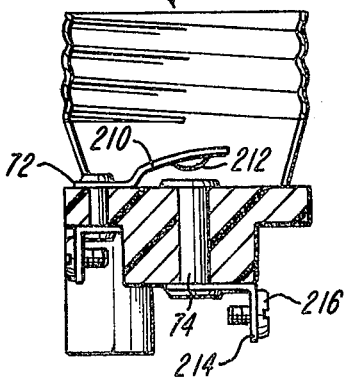
FIG. 9 is a cross sectional view similar to FIG. 8 but showing a socket construction of the type schematically illustrated in FIG. 3.

FIG. 9 illustrates a physical form of the socket 70 of FIG. 3. The base contact 72 is constructed in essentially the same manner as base contact 162 described above but its upwardly extending, free end portion, designated 210, has an arcuately shaped depending contact engaging part 212 overlying the contact 74, which comprises a rivet extending through the socket base and to which is connected a terminal connector 214 having a wire clamping screw 216.

It may be observed from the foregoing discussion and illustrations that relatively minor changes in the physical construction of conventional sockets need be made to form the various embodiments of sockets in accordance with this invention. For many applications the socket construction of FIGS. 7 and 8 used in the circuit of FIG. 6 is preferred when an unpolarized plug is used, although the construction of FIG. 4 may be preferred for some applications because the base contact 162 of FIGS. 6–8 may, with long continued use, become fatigued and require very little pressure thereagainst to maintain the switch 158 closed. Otherwise the arrangements of FIGS. 6–8 are preferred because of the use of a less expensive 2-pole relay and because one inserting his finger into the socket 164 would need to place pressure against the base contact 162 in order to close the switch 158 and not merely engage the base contact as is the case in FIG. 4. The arrangements shown in FIGS. 3 and 9 are preferred over the construction of FIGS. 1 and 2 for substantially the same reasons. However, where feasible the low power circuitry of FIG. 5 is preferred because of the added benefits thereof discussed above.

Although the presently preferred embodiments of this invention have been described, it will be understood that within the purview of this invention various changes may be made within the scope of the appended claims.

Having thus described my invention, I claim:

1. In apparatus for connecting electrical load devices having two terminals to an electrical energy source of the type having a socket having first contact means for engaging one of said terminals and second contact means for engaging the other of said terminals, circuit means including a make switch which, when said make switch is closed, is adapted to operatively connect said socket to an electrical energy source, and electrically operable means adapted to be energized upon closure of said make switch, the improvement wherein said make switch is a normally open momentary switch, said circuit means includes a holding switch closed when said electrically operable means is energized so that said socket is operatively connected to the source, and wherein one of said socket contact means comprises two contact parts that are electrically interconnected when a load device is in said socket and electrically unconnected when no load device is in said socket, said two contact parts being electrically connected to said electrically operable means and the source so that said electrically operable means will be in an energized state when said momentary make switch is opened only if said two contact parts are electrically interconnected when said make switch is closed and only so long as said two contact parts remain electrically interconnected.

2. The apparatus of claim 1 wherein said electrically operable means comprises a relay.

3. The apparatus of claim 2 wherein said circuit means includes three conductors connected respectively to one and the other of said two contact parts and the other socket contact means, said holding switch being in one of said conductors, wherein there are two other holding switches, one being in each of the others of said three conductors, and wherein said relay simultaneously operates each of said holding switches.

4. The apparatus of claim 1 wherein said contact parts are adapted to be electrically interconnected by engagement thereof with a terminal of a load device located within said socket.

5. The apparatus of claim 1 wherein said contact parts are adapted to be interengaged when a load device is located within said socket.

6. The apparatus of claim 1 wherein said one of said contact means is a base contact means.

7. The apparatus of claim 6 wherein said socket includes a base to which said base contact means is connected, and one of said contact parts comprises a spring blade member which, when not under pressure from a load device or the like, is spaced from the other of said contact parts.

8. The apparatus of claim 6 wherein said base contact means includes a load base terminal engaging contact and a switch mounted within said socket, said switch having a plunger adapted to be engaged and depressed by said load base terminal engaging contact when said last mentioned contact is placed under pressure by a load device or the like.

9. The apparatus of claim 8 wherein said load base terminal engaging contact comprises a spring blade member which, when not under pressure from a load device or the like, does not depress said plunger.

10. The apparatus of claim 1 wherein said circuit means further includes means connected to said electrically operable means and the source to cause deenergization of said electrically operable means so that said holding switch is opened.

11. A circuit for connecting electrical load devices having two terminals to an electrical energy source, comprising:

a socket having first contact means for engaging one of said terminals and second contact means for engaging the other of said terminals, one of said first and second contact means comprising two contact parts that are electrically interconnected when a load device is in said socket and electrically unconnected when no load device is in said socket;

first circuit means connecting said first contact means to said source including a holding switch electrically connected between said first contact means and said source;

second circuit means connecting said second contact means to said source;

one of said first and second circuit means including conductor means electrically connected to one of said two contact parts;

third circuit means connected electrically between the other of said contact parts and the other of said first and second contact means, said third circuit means including electrically operable means for closing said holding switch;

a normally open, momentary make switch connected electrically between said electrically operable means and said source and operable upon closure thereof when a load device is in said socket to cause energization of said electrically operable means to cause closure of said holding switch; and means connected electrically between said electrically operable means and said source and operable when a load device is in said socket to cause deenergization of said electrically operable means so that said holding switch is opened.

* * * * *

UNITED STATES PATENT OFFICE

CERTIFICATE OF CORRECTION

PATENT NO. : 4,008,403

DATED : February 15, 1977

INVENTOR(S) : Manning I. Rose

It is certified that error appears in the above-identified patent and that said Letters Patent are hereby corrected as shown below:

Col. 1, line 46, "provide" should be ---prevent---.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*